US009283463B2

(12) United States Patent
Zimmerman, II et al.

(10) Patent No.: US 9,283,463 B2
(45) Date of Patent: Mar. 15, 2016

(54) GOLF SWING TRAINING APPARATUS

(71) Applicant: Fitness South, LLC, Birmingham, AL (US)

(72) Inventors: Richard Zimmerman, II, Bentonville, AR (US); David Lee Stone, Lowell, AR (US); Joseph E. Austin, Rogers, AR (US); Philip Walker, Bella Vista, AR (US)

( * ) Notice: Subject to any disclaimer, the term of this patent is extended or adjusted under 35 U.S.C. 154(b) by 641 days.

(21) Appl. No.: 13/633,595

(22) Filed: Oct. 2, 2012

(65) Prior Publication Data

US 2014/0011602 A1 Jan. 9, 2014

Related U.S. Application Data

(60) Provisional application No. 61/667,788, filed on Jul. 3, 2012.

(51) Int. Cl.

| | |
|---|---|
| ***A63B 69/36*** | (2006.01) |
| ***A63B 21/012*** | (2006.01) |
| ***A63B 23/035*** | (2006.01) |
| ***A63B 21/00*** | (2006.01) |
| *A63B 69/38* | (2006.01) |
| *A63B 69/00* | (2006.01) |

(52) U.S. Cl.

CPC ..... *A63B 69/3644* (2013.01); *A63B 21/00069* (2013.01); *A63B 21/0125* (2013.01); *A63B 21/4045* (2015.10); *A63B 23/03516* (2013.01); *A63B 21/4035* (2015.10); *A63B 69/38* (2013.01); *A63B 2069/0008* (2013.01); *A63B 2208/0204* (2013.01); *A63B 2225/09* (2013.01)

(58) Field of Classification Search

USPC ..... 473/226, 229, 257, 258, 261, 409

See application file for complete search history.

(56) References Cited

U.S. PATENT DOCUMENTS

| | | | | |
|---|---|---|---|---|
| 1,634,102 | A * | 6/1927 | Hansen | 473/229 |
| 1,960,787 | A * | 5/1934 | MacStocker | 473/229 |
| 3,794,329 | A * | 2/1974 | Wilson | 473/229 |
| 5,439,225 | A * | 8/1995 | Gvoich et al. | 473/223 |
| 6,579,214 | B2 | 6/2003 | Crump | |
| 6,935,968 | B1 * | 8/2005 | Thomas | 473/296 |
| 7,144,340 | B1 * | 12/2006 | Jones et al. | 473/409 |
| 7,153,245 | B2 | 12/2006 | Kim | |
| 7,238,116 | B1 | 7/2007 | Sulzener | |
| 7,862,444 | B2 * | 1/2011 | Jones | 473/257 |
| D636,042 | S | 4/2011 | Campitelli | |
| 7,946,927 | B2 | 5/2011 | Bowers | |
| 7,988,563 | B2 | 8/2011 | Turner | |
| 8,007,421 | B2 | 8/2011 | Goel et al. | |
| 2008/0153618 | A1 * | 6/2008 | Arther | 473/259 |

FOREIGN PATENT DOCUMENTS

GB 2347630 A * 9/2000

* cited by examiner

*Primary Examiner* — Nini Legesse
(74) *Attorney, Agent, or Firm* — Boyd D. Cox

(57) ABSTRACT

A golf swing training apparatus and method of enhancing muscle tone and improving swing form includes a swing device that guides a user's swing along a predetermined path in a selected swing plane to improve form and enhance muscle memory for a preferred swing. A tensioning device enables the user to adjust the resistance to his or her swing, increasing resistance to strengthen muscles used while executing the preferred swing. The apparatus is adjustable for individuals of varying height, size, strength and ability.

38 Claims, 6 Drawing Sheets

GOLF SWING TRAINING APPARATUS

Priority for this application is claimed from U.S. Provisional Application No. 61/667,788 entitled "Golf Training Apparatus" filed on Jul. 3, 2012

BACKGROUND

The present invention is directed to a golf swing training apparatus for teaching a preferred path upon which to swing a golf club and, simultaneously, strengthening the muscles used to move the club along such swing path.

Golfing requires a multitude of skills and strength in addition to applying knowledge of proper form for correctly swinging the golf club. Many types of devices have been developed for improving the swing of a golfer.

Each golfer has an individualized size and style that must be taken into consideration for effective learning or teaching the sport. The height, body shape and swing of each golfer are ail unique characteristics that must be addressed when using a training device.

Conventional training devices do not provide guidance with respect to a proper swing path while increasing the strength of the muscles used in performing the required swing. Furthermore, there is a lack of adjustability in conventional devices and, therefore, such devices fail to suit the needs of many potential users having incompatible physical characteristics. This lack of adjustability diminishes the versatility of these prior art training devices. Consequently, additional devices are needed to train users having different size requirements.

The swing training apparatus of the present invention provides means for a user to learn how to correctly swing a golf club while strengthening the muscles required to perform such action. Additionally, the apparatus is highly versatile, being adjustable to fit golfers of varying physical attributes and abilities.

SUMMARY

The golf swing training apparatus and method of using the present invention includes a swinging device having an inner guide loop that pivots within an outer base loop. The inner guide loop is moved by a user swinging a simulated golf club. A tensioning device is provided to create resistance to movement of the inner guide loop. The resistance can be adjusted to different tensions, each tension requiring a different magnitude of force to move the inner guide loop. The greater the resistance, the more participation is required by targeted muscles of the user. For users having lower skill levels, the selected resistance can be relatively low. As a trainee progresses, the resistance can be increased incrementally to develop the musculature used for swinging a club, as well as the muscle memory of swinging the club and proper form of the user.

In addition, the apparatus is adjustable to fit the particular body height and shape of a golfer and adjustable to the proper swing plane angle for that golfer. Consequently, one can train correctly for his or her particular body type and for his or her particular swing.

It is an object of the present invention to provide a golf training apparatus that increases muscle tone for a golf swing.

It is a further object of the present invention to provide a swing training apparatus that teaches a correct swing motion.

It is a further object of the present invention to provide a golf training apparatus that simultaneously teaches a user to swing a golf club on a preferred path and strengthens the muscles used to make such a swing.

It is a further object of the present invention to provide a golf training apparatus that reinforces the proper muscle memory for an individual golfing swing.

It is a further object of the present invention to provide a swing training apparatus for increasing muscle strength.

It is a further object of the present invention to provide a swing training apparatus that can be adjusted to fit the height and shape of the user.

It is a further object of the present invention to provide a golf training apparatus that can be adjusted to fit the height and shape of a golfer.

It is a further object of the present invention to provide a golf training apparatus that has variable resistance to change the amount of force required to swing a club.

It is a further object of the present invention to provide a swing training apparatus whereby the angle of the swing plane can be adjusted.

It is a further object of the present invention to provide a golf training apparatus that correctly trains for an individual user's particular body type.

It is a further object of the present invention to provide a golf training apparatus that can be adjusted to a user's individual characteristics.

It is a further object of the present invention to provide a method of improving muscle tone for a selected swing motion.

It is a further object of the present invention to provide a method of improving a user's swing form adapted to a particular sport.

It is a further object of the present invention to provide a method of enhancing muscle tone for a user's golf swing motion.

It is a further object of the present invention to provide a method of improving a user's swing form for golfing.

It is a further object of the present invention to provide a golf swing training apparatus having a simulated club that is guided along a predetermined path.

It is a further object of the present invention to provide a swing training apparatus that creates resistance to the swing force exerted by a user as he or she swings a simulated club along a predetermined path.

BRIEF DESCRIPTION OF THE DRAWINGS

Reference is made to the accompanying drawings in which is shown an illustrative preferred embodiment of the invention and from which novel features and advantages will be apparent.

DETAILED DESCRIPTION

Figure 1:
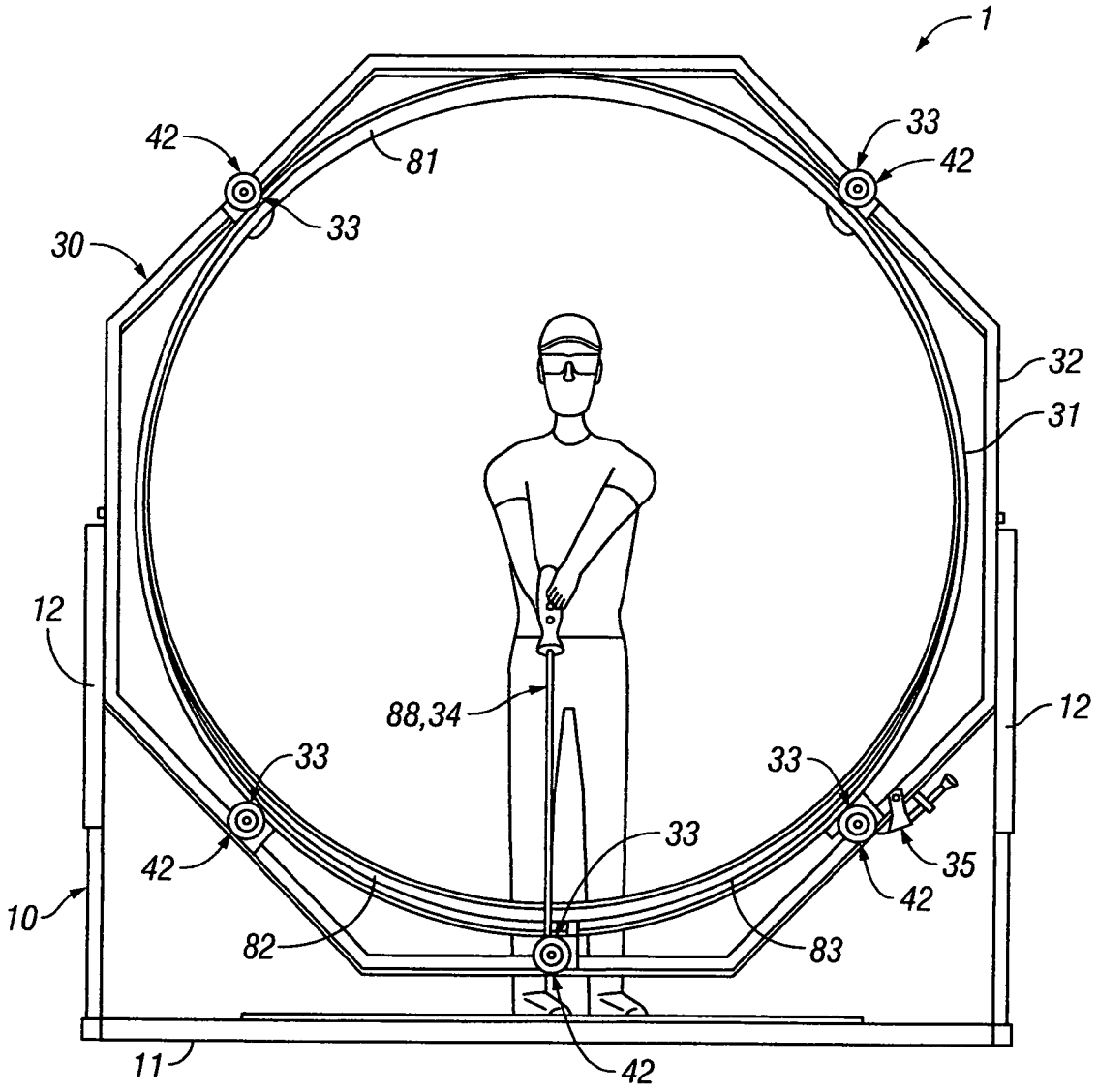
FIG. 1 is a front planar view of a preferred embodiment of the golf training apparatus of the present invention with a golfer holding a simulated club at a lowermost position.
Figure 2:
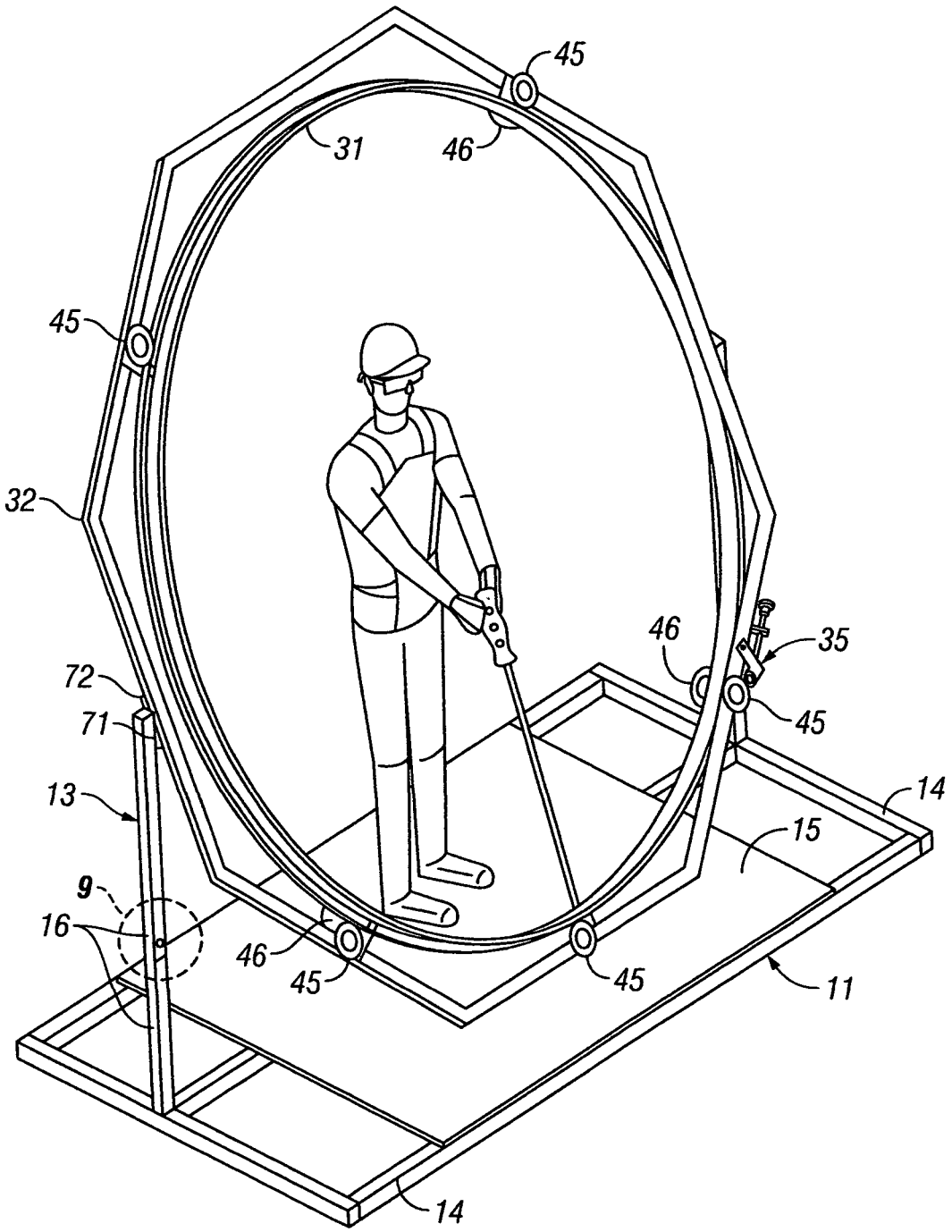
FIG. 2 is a side perspective view of the golf training apparatus of FIG. 1 with the golfer holding the simulated club at the lowermost point.
Figure 5:
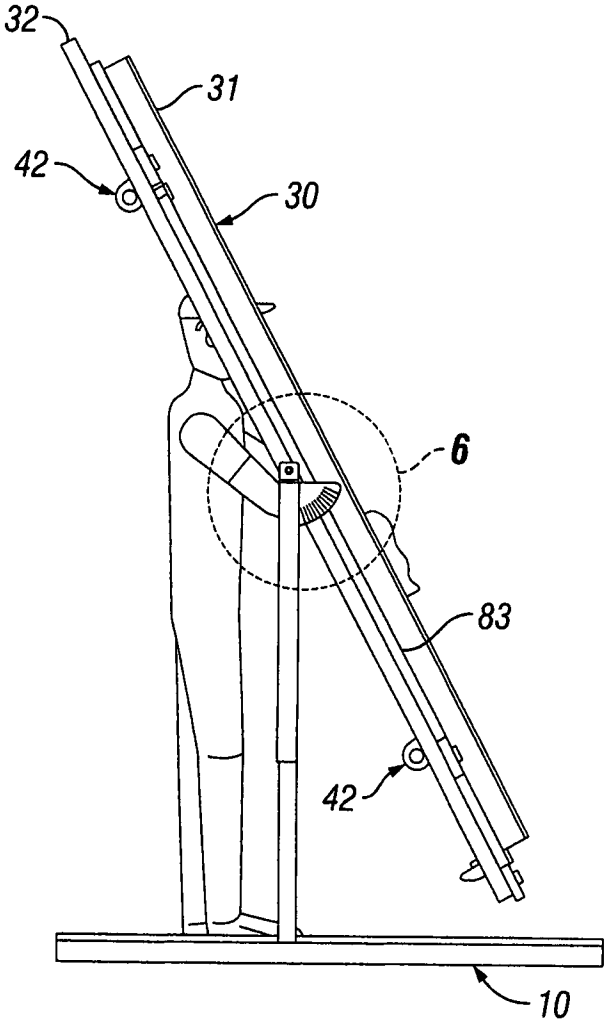
FIG. 5 is a side view of the golf training apparatus of FIG. 1 with a golfer standing on a platform.

As shown in FIGS. 1, 2, and 5 of the drawings, a preferred embodiment of the golf training apparatus (1) of the present invention includes a swinging device (30), a stand (10) for supporting the swinging device (30) and a means for adjusting the swing plane of the swinging device. The means for adjusting the swing plane is an angle adjuster (70).

The swinging device (30) includes an inner guide loop (31), an outer base loop (32), means for moveably supporting the inner guide loop on the outer base loop, means for maintaining variable resistance on the inner guide loop and means for moving the inner guide loop on the outer base loop.

The inner guide loop (31) is a swing track having an inside surface (81), an outside surface (82), a guide rail (83) and a tool guide (84). The outer base loop (32) provides support for the inner guide loop (31).

Figure 3:
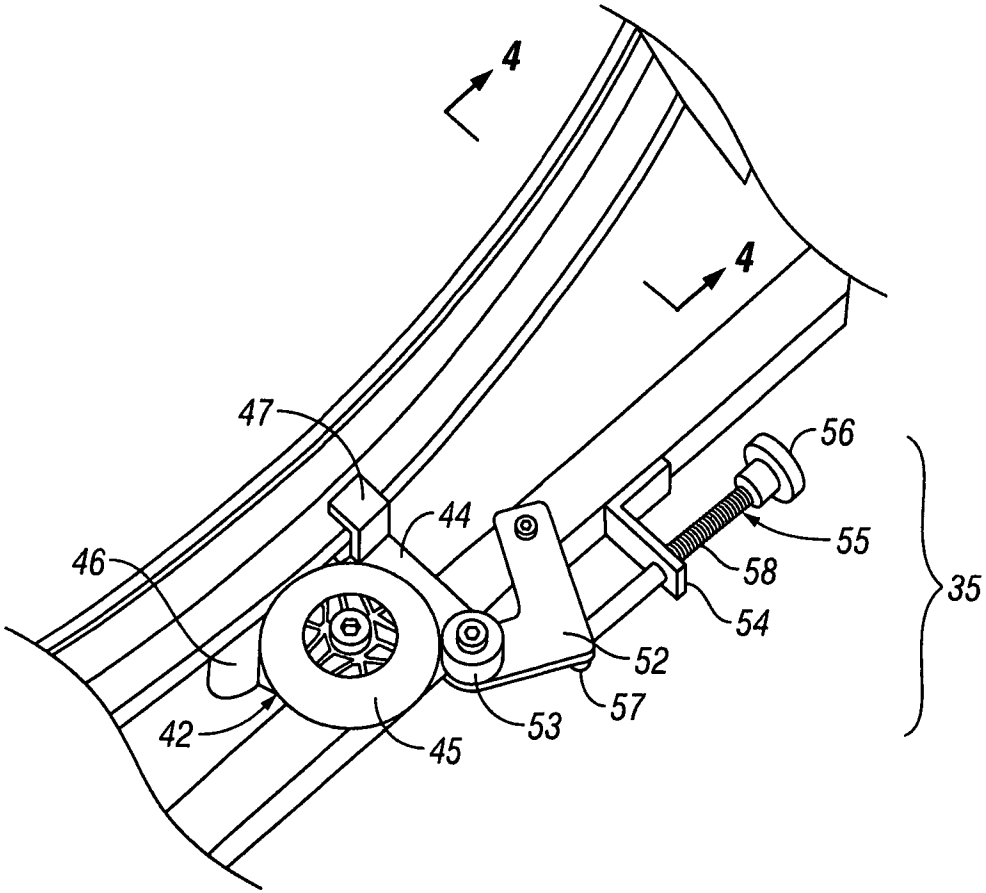
FIG. 3 is a partial perspective view of the tensioning device on the golf training apparatus of FIG. 1.

Means for moveably supporting the inner guide loop on the outer base loop is a loop holder (33). The loop holder (33) comprises a plurality of roller supports (42) disposed around the perimeter of the outer base loop (32). Each of the roller supports (42) comprises first (45) and second (46) rollers and a supporting bracket (44) as shown in FIG. 3.

The means for maintaining variable resistance on the inner guide loop is a tensioning device (35) and a tension adjuster (55).

Figure 7:
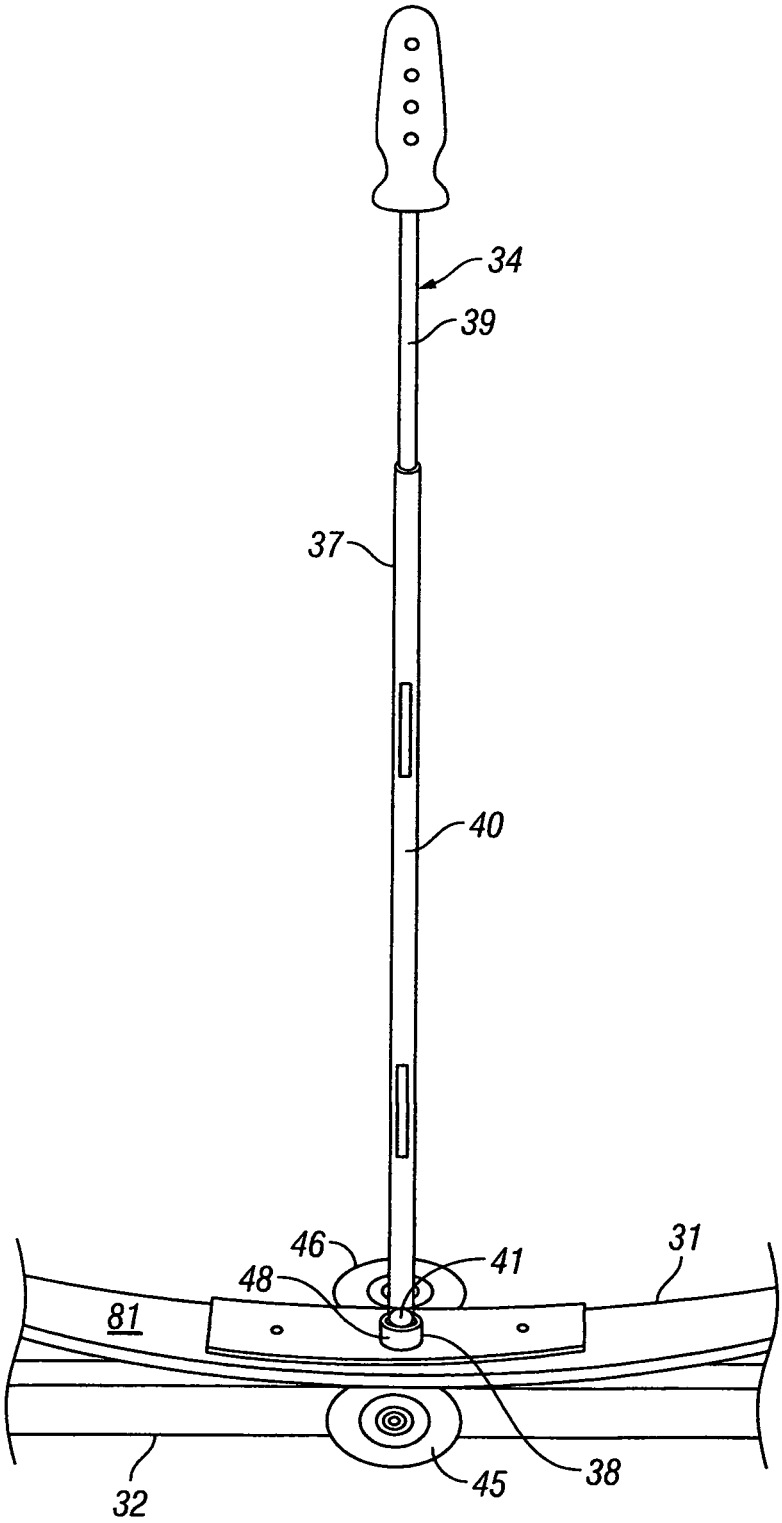
FIG. 7 is a partial perspective view of the simulated golf club and a portion of the inner guide loop and outer base loop of the golf training apparatus of FIG. 1.

Referring to FIGS. 1 and 7, the means for moving the inner guide loop on the outer base loop is a tool (88), preferably a simulated club (34) having a shaft (37) with a grip (36) on a proximal end and universal joint (38) on the opposite, distal end attached to the inner guide loop (31). The shaft (37) comprises inner (39) and outer (40) telescoping rods that slide relative to each other, thereby enabling the length of the shaft (37) to vary.

The inner guide loop (31) is substantially circular in its overall shape and is sized to fit within the outer base loop (32). Consequently, the inner guide loop (31) has a diameter that is less than a general diameter or width of the outer base loop (32). In a preferred embodiment, the outer base loop (32) is substantially octagonally shaped. However, the shape of the outer base loop could vary, if desired. For instance, the outer base loop could be substantially circular, square, or any other shape that would adequately support the inner guide loop.

The tension adjuster (55) of the tensioning device (35) shown in FIGS. 1-3 is an elongated element having a first end which comprises a handle (56), a second end which comprises an engaging portion (57), and a midsection disposed between the first and second ends. The midsection has a threaded portion (58) that is threadedly engaged with and supported on the angle bracket (54). Preferably, the tension shoe (53) is a wheel and is adapted to frictionally engage the first roller (45) of the roller support (42). The tension shoe (53) can be adjusted to provide various selected magnitudes of resistance in order to selectively modulate movement between the inner guide (31) and outer base (32) loops when a user is swinging the simulated club (34) on the apparatus (1).

Each of the supporting brackets (44) on the roller supports (42) has a stabilizing arm (47). The stabilizing and (47) of each support bracket (44) is generally L-shaped and fits over and partially surrounds the guide rail (83). The guide rail (83) slides within the stabilizing arms (47) as the inner guide loop (31) moves relative to the outer base loop (32).

The tool guide (84) on the inner guide loop (31) is preferably made of ultra-high molecular weight polyethylene which allows an actual golf club to be drawn along the front edge of the inner guide loop during a practice swing without damaging the golf club. It is noted that other suitable materials could be used, if desired.

The shaft (37) of the simulated club (34) is preferably made from steel. However, other suitable materials, such as graphite or fiberglass, could be used instead.

The stand (10) supports the swinging device (30) of the golf training apparatus (1). The stand (10) includes a base (11), a pair of upright supports (12), and means for adjusting the height of the swinging device. The base (11) includes a frame (14) adapted for resting on a supporting surface and a platform (15) mounted atop the frame (14). On the stand (10), the platform (15) provides an area on which a user can stand during training. The overall length of each upright support (12) can be adjusted in order to vary the height of the swinging device (30). By changing the height of the upright supports (12), the golf swinging device (1) can be adjusted to accommodate differently sized users.

Figure 9:
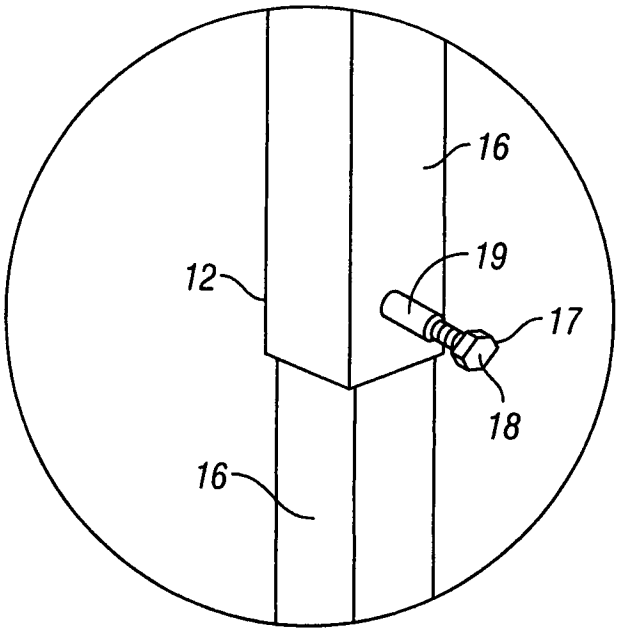
FIG. 9 is a partial perspective view of a lock on the height adjustment device and an upright support of the golf training apparatus shown at 9 in FIG. 2.
Figure 8:
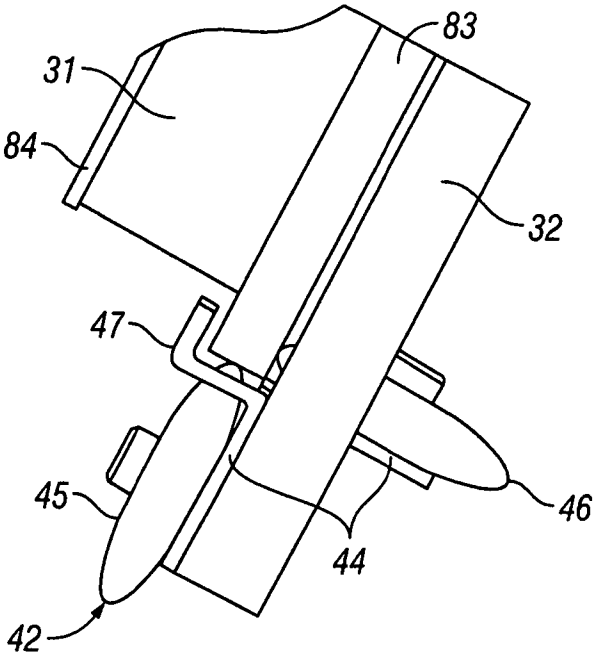
FIG. 8 is a partial side view of a roller support of the golf training apparatus of FIG. 1, wherein the roller support is mounted on the outer base loop and engages the inner guide loop.

The means for adjusting the height of the swinging device, as shown in FIG. 9, is a height adjustment device (13) that is infinitely adjustable. Each of the upright supports (12) of the stand (10) comprises a pair of adjustable telescoping members (16). The height adjustment device (13) includes a pair of locks (17). A lock (17) is disposed on each of the upright supports (12) and releasably holds the telescoping members (16) of the respective upright support (12) in a selected adjustable position. The lock (17) includes a set screw (18) and a threaded sleeve (19). The set screw (18) is disposed within the threaded sleeve (19) and is threadedly engaged therewith. The set screw (18) can be rotated in one direction in order to engage with the cooperating telescoping member (16). When engaged, the set screw (18) locks the adjustable telescoping members (16) of the respective upright support (12) in the selected position for a desired height of the swinging device (30). Conversely, the set screw (18) can be rotated in an opposite direction to release the lock (17), allowing the respective telescoping members to slide relative to each other.

Figure 6:
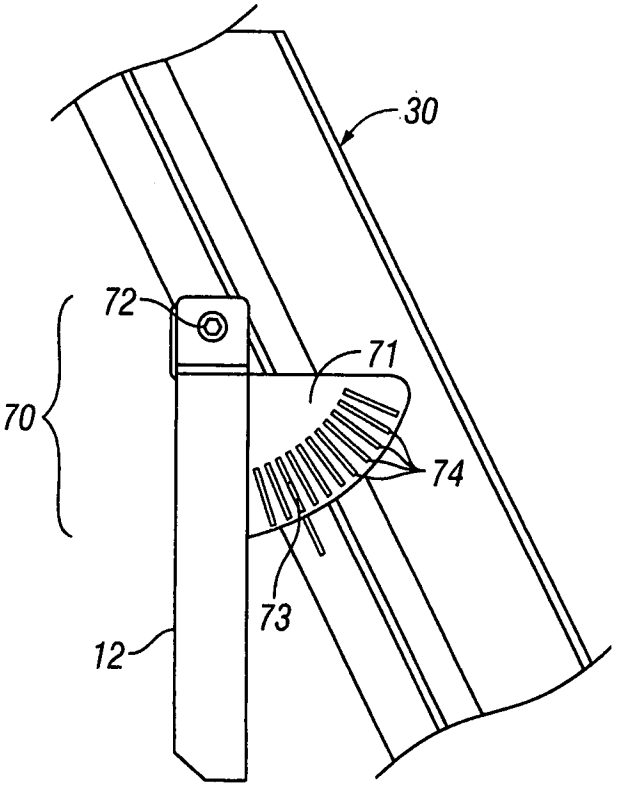
FIG. 6 is a partial side view of the means for adjusting the swing plane on the golf training apparatus of FIG. 1.

Means for adjusting the swing plane of the swinging device (30) is an angle adjuster (70), as shown in FIGS. 5 and 6. The angle adjuster (70) adjustably supports the swinging device (30) at various selected angles on the stand (10) and comprises a pair of angular pivot joints (72) and an angle gauge (71). The angle gauge (71) includes a series of lock apertures (74) and a lock pin (73). The angle gauge (71) indicates the particular angle at which the swinging device (30) is set. The angular pivot joints (72) connect the outer base loop (32) to respective upright supports (12) of the stand (10). The angular pivot joints (72) pivotally support the swinging device (30) on the stand (30). The angular adjuster (70) can be locked into the selected position by engaging the lock pin (73) with the particular lock aperture (74) associated with the selected angle. By setting the swinging device (30) at various selected angles, each of which represents a unique swing plane, the golf training apparatus (1) can be adapted for use by different individuals.

Referring to FIG. 7, the telescoping rods (39, 40) comprised by the shaft (37) of the simulated club (34) slide relative to each other to change the effective length of the simulated club's shaft (37). During use, the golfer holds the grip (36) of the club (34) and begins the swing by bringing the club (34) back into a back swing and then starts the forward swing by bringing the club (34) down and forward. Throughout the swing, the effective length of the club's shaft (37) typically changes since the inner (39) and cuter (40) telescoping rods are free to slide relative to each other.

The simulated club (34) is removably attached to the inside surface (81) of the inner guide loop (31) by the universal joint (38) which includes a ball (41) and socket (48). The universal joint (38) allows rotational movement of the simulated club (34) with respect to the inner guide loop (31) so that the user can freely swing the simulated club (34) backwards and forwards during use. The ball (41) pivots within the socket (48) of the universal joint (38). The ball (41) can be selectively snapped out of the socket (48) when it is desirable to remove the simulated golf club (34) from the inner guide loop (31). Conversely, the simulated club (34) can be reattached to the inner guide loop (31) by snapping the ball (41) back into the socket (48).

Figure 4:
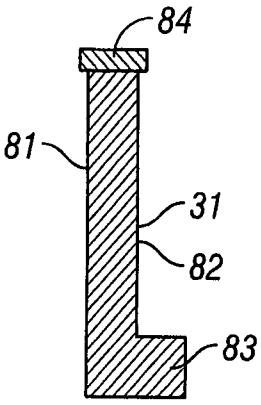
FIG. 4 is a partial cross sectional view of the inner guide loop of the golf training apparatus of FIG. 2 taken along line 4-4 in FIG. 3.

The tool guide (84) shown in FIG. 4 is disposed along a front edge of the inner guide loop (31) and functions to protect an actual golf club from damage when the club is swung around the inner guide loop (31). In such an alternate use, the simulated club (34) is preferably removed from the inner guide loop (31) as previously mentioned and an actual golf club can be drawn along the front edge of the inner guide loop (31). During such use, the tool guide (84) on the inner guide loop (31) can directly engage the shaft of the golf club. The shaft can smoothly slide along the tool guide (84) without marring the club's shaft.

The outer base loop (32) of the swinging device (30) supports the inner guide loop (31). The plurality of roller supports (42) holds the inner guide loop (31) onto the outer base loop (32) and allows the inner guide loop (31) to pivot or roll on the first (45) and second (46) rollers shown in FIGS. 1-4 and 8. The first (45) and second (46) rollers also stabilize the inner guide loop (31). The stabilizing arm (47) of the supporting bracket (44) partially surrounds the guide rail (83) of the inner guide loop (31) and assists in supporting the inner guide loop (31) in position on the outer base loop (32).

The tensioning device (35) provides a variable resistance between the inner guide loop (31) and the outer base loop (32). The resistance to the movement of the inner guide loop (31) on the outer base loop (32) can be selectively adjusted to varying degrees ranging from negligible resistance to strong resistance. The tension adjuster (55) of the tensioning device (35) functions to increase or decrease the resistance that is applied through the tension shoe (53) to the first roller (45) of the adjacent roller support (42). The angle bracket (54) threadedly engages and supports the elongated tension adjuster (55). The tension shoe (53) is disposed on the pivot arm (52) and is adapted to engage the first roller (45) of the adjacent roller support (42). By rotating the handle (56), the tension adjuster (55) can be moved toward and away from said roller (45) to vary the pressure exerted by the tension shoe (53) on the first roller (45) of the adjacent roller support (42). The pressure applied to the first roller (45) by the tension shoe (53) creates resistance to movement of the inner guide loop (31). The resistance applied to the inner guide loop (31) by the tensioning device (35) can be increased or decreased to modulate the ease with which the inner guide loop (31) and an attached simulated club (34) can be moved.

The greater the resistance that is applied to the first roller (45) via the tensioning device (35), the more force is required by the user to swing the simulated club (34) and move the inner guide loop (31) within the outer base loop (32). This resistance during the swing enhances the user's muscle strength and memory. Conversely, the less the resistance applied to the first roller (45), the less force is required by a user to swing the stimulated club (34) and move the inner guide loop (31).

The inner guide loop (31) is disposed within the cuter base loop (32) and held in place on the outer base loop (32) by the roller supports (42). The roller supports (42) are spaced around a perimeter of the outer base loop (32) as shown in FIG. 1. On the inner guide loop (31), the guide rail (83) is disposed on the outside surface (82) of the inner guide loop (31) adjacent to a rear edge thereof, while the tool guide (84) is disposed along a front edge of the inner guide loop (31). On each roller support (42), the first (45) and second (46) rollers are disposed generally perpendicular to each other, such that the first roller (45) engages one side of the guide rail (83) and the second roller (46) engages another side of the guide rail (83) that is generally perpendicular to the guide rail's one side. Each of the supporting brackets (44) is attached to the cuter base loop (32) and supports a respective first (45) and second (46) roller thereon. Each supporting bracket (44) includes a stabilizing arm (47) that fits over a portion of the guide rail (83). Each of the stabilizing arms (47) allows the guide rail (83) to slide through as the inner guide loop (31) rotates with respect to the cuter base loop (32).

Each of the upright supports (12) of the stand (10) is mounted at a lower end onto the base (11). The upper ends of the upright supports (12) are mounted to opposite sides of the swinging device (30). The platform (15) is disposed on the frame (14) of the base (11).

The means for adjusting the swing plane is disposed on the upright supports (12) of the stand (10). One of the pivot joints (72) of the angle adjuster (70) attaches the upper end of a respective upright support (12) to one side of the outer base loop (32). The other of the pivot joints (72) attaches the upper end of the other upright support (12) to an opposite side of the outer base loop (32). The angle gauge (71) is positioned on one of the upright supports (12). The angle gauge (71) includes a plurality of slot-shaped lock apertures (74) that are adapted to receive the lock pin (73) therein.

To adjust the swing plane, the angle for the desired swing plane is selected on the angle gauge (71). The swinging device (30) is then positioned to coincide with the selected angle and the lock pin (73) is inserted into the associated lock aperture (74) to thereby secure the selected angle for the swing plane of the swinging device (30).

On the simulated club (34), the universal joint (38) pivotally joins the shaft (37) of the simulated club (34) to the inside surface (81) of the inner guide loop (31). The universal joint (38) is comprised of a ball (41) and socket (48). The ball (41) is pivotally held within the cooperating socket (48) by a snap fit. When desired, the ball (41) of the universal joint (38) can be removed from the socket (48) to detach the simulated club (34) from the inner guide loop (31).

The inner guide loop (31) is sized to fit within the outer base loop (32) as shown in FIG. 1. The inner guide loop (31) is held in position by the plurality of roller supports (42). The roller supports (42) are supported on the outer base loop (32). Consequently, the inner guide loop (31) is held within the cuter base loop (32). The tensioning device (35) is attached to the outer base loop (32) adjacent to one of the roller supports (42) as shown in FIG. 3. The tensioning device (35) applies pressure to the first roller (45) that acts as a brake to hinder movement of the inner guide loop (31). The resistance applied to the first roller (45) through the tensioning device (35) is imparted to a golfer as he or she swings the simulated club (34).

Four roller supports (42) are spaced generally equidistantly apart around a perimeter of the outer base loop (32) and a fifth roller support (42) is disposed to engage the lowermost point of the inner guide loop (31) supported thereby. The rollers (45,46) of each roller support (42) are disposed generally perpendicular to one another with the first roller (45) having an axis of rotation that is generally at a right angle to the axis of rotation of the second roller (46). Consequently, each of the first (45) and second (46) rollers engage adjacent sides of the guide rail (83).

At the beginning of the swing, the shaft (37) of the simulated club (34) is extending generally downward with the universal joint (38) being at an approximate lowermost point on the inner guide loop (31). As the simulated club (34) is drawn back, the distal end of the simulated club (34) moves in an upward circular motion. Since the distal end of the simulated club (34) is attached by the universal joint (38) to the inside surface (81) of the inner guide loop (31), the inner guide loop (31) moves on the roller supports (42) in a circular motion along with the simulated club's movement. The inner guide loop (31) moves in direct response to the movement of the distal end of the simulated club (34).

The simulated club (34) can rotate 360 degrees and the user can swing the club (34) in both backward and forward motions. The simulated club (34), when actuated by a user, typically precipitates the movement of the inner guide loop (31) which also can rotate a full 360 degrees on the outer base loop (32).

To use the golf training apparatus (1) of the present invention the apparatus is adjusted to the individual user by adjusting the height of the swing device with the height adjustment device (13), adjusting the swing plane of the apparatus with the angle adjuster (70) and setting the desired resistance with the tensioning device (35).

The user stands on the platform and grasps the simulated club (34) with a stance similar to that conventionally recognized for addressing the golf ball with a particular club. With hands on the grip (36) of the simulated club (34), the user takes a backswing whereby he or she brings the club back. Once the simulated club (34) is positioned at the top of the back swing, the user swings the simulated club (34) down, forward and through the golf swing. In order to build muscle tone and develop muscle memory for the correct swing, this swinging action can be repeated. The resistance on the inner guide loop can be changed as desired. In a preferred use, the resistance is increased incrementally as the resultant strength of the user increases.

To increase the resistance on the inner guide loop (31), the tension adjuster (55) of the tensioning device (35) is actuated. By turning the handle (56) on the first end thereof, the tension adjuster (55) rotates and the threaded portion (58) moves through the angle bracket (54) threadedly supporting the mid-section of the tension adjuster (55). As a result, the engaging portion (57) of the tension adjuster moves forward thereby pushing the pivot arm (52) of the tensioning device (35) toward the first roller (45) increasing pressure of the tension shoe (53) against the first roller (45). The greater the pressure exerted against the first roller (45) by the tension shoe (53), the greater the resistance provided by the tensioning device (35) becomes, and the greater the force required to move the inner guide loop (31) becomes. Conversely, the less pressure that is exerted against the first roller (45) by the tension shoe (53), the less is the resistance provided by the tensioning device (35) on the inner guide loop (31) and the less is the force required to move the inner guide loop (31).

To decrease the resistance on rotation of the inner guide loop (31), the tension adjuster (55) is turned in an opposite direction. When the handle (56) is turned in the opposite direction, the tension adjuster (55) moves within the angle bracket (54) away from the pivot arm (52). As the tension adjuster (55) moves away from the pivot arm (52), the engaging portion (57) of the second end of the tension adjuster (55) decreases pressure on the pivot arm (52) so that the tension shoe (53) releases pressure and resistance on the first roller (45). Therefore, in order to release the pressure exerted on the first roller (45) and to reduce the resistance of the tensioning device (35), the tension shoe (53) is moved in a direction away from the first roller (45).

As the user moves through his or her swing with the simulated club (34), the shaft (37) of the simulated club (34) automatically changes length. The change in length of the shaft (37) is due to the telescoping rods (39,40) comprising the shaft (37). The rods (39,40) are able to slide relative to each other as the club (34) swings around the arc determined by the inner guide loop (31).

The golf training apparatus of the present invention promotes correct golf swing characteristics while discouraging incorrect ones. For instance, the apparatus encourages a user to perform a correct take-away, turn and downswing while keeping the club on the proper plane throughout the swing, and inhibits lagging the club upon take-away, bringing the club inside on the upswing and casting the club during the downswing. Consequently, the user is able to feel the proper form for swinging the club, as well as developing the strength for swinging the club.

The golf training apparatus of the present invention provides variable resistance training for a user to improve his or her golf swing by increasing muscle tone specific to the user's swing. The resistance training also develops the particular muscle memory for each individual's golf swing. The apparatus enables the user to practice his or her golf swing within the correct swing plane which reinforces the correct form. This is advantageous in developing the muscle memory for that correct swing form. The golf training apparatus can be adjusted for each individual user by the means for adjusting the height of the swinging device and the means for adjusting the swing plane of the swinging device.

Furthermore, the tensioning device is adjustable so that the resistance can be increased or decreased in accordance with the user's training needs. The resistance offered by the golf training apparatus of the present invention provides a myriad of advantages for training, including that of encouraging the user to turn his or her hips to start the downswing, activating the abdominal muscles of the user while keeping the lower body stable throughout the swing and assisting the user to maintain the proper angle between his or her arms and the club shaft during the swing.

In an alternate use, the simulated club (34) can be removed from the inner guide loop (31) of the apparatus (1) by snapping the ball (41) out of the socket (48) of the universal joint (38) on the club's shaft (37). With the simulated club (34) detached from the inner guide loop (31), the user can practice with his or her own golf club by standing on the platform (15) of the apparatus and resting the shaft of his or her own golf club against the tool guide (84) on the inner guide loop (31). The user then swings, sliding the club's shaft around the inner guide loop (31) while keeping it the shaft against the tool guide (84) throughout the entire swing. It is desirable that the swing mimic the form of the swing motion used during resistance training with the simulated club (34) attached to the apparatus (1).

It is noted that the golf training apparatus of the present invention may be modified to train and strengthen swings used in other sports, such as baseball, Softball, tennis, and the like. In such cases, the simulated club would be replaced with a simulated bat, racket, etc. and the swinging device and angle adjuster would be adapted to simulate the swings utilized in the particular sport for which improvement is desired.

Although the present invention has been described in considerable detail with reference to a certain illustrative embodiment, other embodiments are possible. Therefore, the spirit and scope of the appended claims should not be limited to the description of the preferred version contained herein.

The invention claimed is:

1. A golf training apparatus comprising:

a swinging device; and a stand for supporting the swinging device;

said swinging device comprises a guide loop, a base loop, a loop holder and a simulated club;

wherein said guide loop is moveably supported on the base loop by the loop holder; and wherein said simulated club is attached to said guide loop, whereby swinging said simulated club actuates movement of the guide loop on the base loop;

wherein said loop holder comprises a plurality of roller supports disposed on said base loop and supporting said guide loop; and wherein each roller support comprises a first roller, a second roller and a supporting bracket, said first and second rollers are mounted on said supporting bracket, each of said roller supports is fixedly mounted on said base loop, and each of said first and second rollers engages said guide loop.

2. The golf training apparatus of claim 1, wherein said simulated club comprises a universal joint and said simulated club is attached to said guide loop by said universal joint.

3. The golf training apparatus of claim 2, wherein said universal joint comprises a ball and socket, wherein said ball is removably engaged with said socket.

4. The golf training apparatus of claim 1, wherein said simulated club includes a shaft having a variable length.

5. The golf training apparatus of claim 4, wherein said shaft further comprises a plurality of telescoping rods;

whereby the length of said shaft varies as said telescoping rods slide relative to each other during said swinging of said simulated club.

6. The golf training apparatus of claim 4, wherein said simulated club is pivotally attached to said guide loop by a universal joint.

7. The golf training apparatus of claim 1, wherein said first and second rollers include a respective pivot axis, and said pivot axis of said first roller is disposed generally perpendicularly to said pivot axis of said second roller.

8. The golf training apparatus of claim 7, wherein said guide loop is a swing track comprising opposing inside and outside surfaces, and a guide rail; wherein said guide rail extends outwardly from said outside surface;

said first and second rollers engage said guide rail;

each of said supporting brackets further comprises a stabilizing arm that overlays a portion of said guide rail and maintains said guide rail proximate to said first and second rollers.

9. The golf training apparatus of claim 8, wherein said guide loop further comprises a tool guide disposed along a front edge thereof.

10. The golf training apparatus of claim 1, further comprising an adjustable tensioning device for maintaining resistance to movement of the guide loop relative to the base loop.

11. The golf training apparatus of claim 10, wherein said loop holder comprises a plurality of roller supports mounted on said base loop and supporting said guide loop;

wherein said adjustable tensioning device is disposed on said base loop adjacent to one of said roller supports and further comprises a tension shoe, a pivot arm, an angle bracket and a tension adjuster;

wherein said angle bracket is mounted on said base loop and supports said tension adjuster, said pivot arm is pivotally attached to said base loop, and said tension shoe is mounted on said pivot arm; and wherein said tension shoe is adapted to adjustably engage one of said rollers and thereby apply selective resistance to relative movement that occurs between the guide loop and the base loop.

12. The golf training apparatus of claim 11, wherein said tension adjuster comprises a handle, an engaging portion and a threaded portion, wherein said threaded portion is threadedly engaged and supported by said angle bracket, said engaging portion is adapted to move said pivot arm and thereby engage said tension shoe with said first roller when said handle is actuated.

13. The golf training apparatus of claim 1, further comprising an angle adjuster for adjusting the swing plane of the swinging device.

14. The golf training apparatus of claim 1, wherein said stand comprises a base supported by a plurality of upright supports and a height adjustment device for adjusting the height of the swinging device.

15. The golf training apparatus of claim 1, wherein said guide loop is surrounded by said base loop.

16. A golf training apparatus comprising:

a swinging device; and a stand for supporting the swinging device;

said swinging device comprises a guide loop, a base loop, a loop holder and a simulated club;

adjustable tensioning device for maintaining resistance to movement of the guide loop relative to the base loop;

wherein said guide loop is moveably supported on the base loop by the loop holder; and wherein said simulated club is attached to said guide loop, whereby swinging said simulated club actuates movement of the guide loop on the base loop;

wherein said loop holder comprises a plurality of roller supports mounted on said base loop and supporting said guide loop;

wherein said adjustable tensioning device is disposed on said base loop adjacent to one of said roller supports and further comprises a tension shoe, a pivot arm, an angle bracket and a tension adjuster;

wherein said angle bracket is mounted on said base loop and supports said tension adjuster, said pivot arm is pivotally attached to said base loop, and said tension shoe is mounted on said pivot arm; and wherein said tension shoe is adapted to adjustably engage one of said roller supports and thereby apply selective resistance to relative movement that occurs between the guide loop and the base loop.

17. The golf training apparatus of claim 16, wherein said tension adjuster comprises a handle, an engaging portion and a threaded portion, wherein said threaded portion is threadedly engaged and supported by said angle bracket, said engaging portion is adapted to move said pivot arm and thereby engage said tension shoe with said first roller when said handle is actuated.

18. A golf training apparatus for improving swing form and muscle tone of a golfer and maintaining a correct swing plane of the golfer, the golf training apparatus comprising:

a swinging device; and a stand for supporting the swinging device;

said swinging device comprises a base loop, a guide loop, means for moveably supporting the guide loop on the base loop, and means for moving the guide loop on the base loop, wherein said means for supporting the guide loop on the base loop comprises a plurality of roller supports mounted on said base loop and moveably supporting said guide loop;

each of said plurality of roller supports comprises a first roller, a second roller and a supporting bracket; and wherein said first and second rollers are mounted on the supporting bracket, said supporting bracket is mounted on said base loop, and said first roller extends generally perpendicularly to said second roller;

said guide loop comprises opposing inside and outside surfaces and a guide rail;

wherein said guide rail extends outwardly from said outside surface, said first and second rollers engage said guide rail, and said means for moving the guide loop on the base loop is mounted on the inside surface of said guide loop.

19. The golf training apparatus of claim 18 wherein said swinging device further comprising means for maintaining variable resistance on the guide loop.

20. The golf training apparatus of claim 18, wherein said stand further comprises means for adjusting the height of the swinging device.

21. The golf training apparatus of claim 18, wherein said swinging device includes a swing plane, said guide loop is generally disposed within said swing plane, and said golf training apparatus further comprises means for adjusting the swing plane of the swinging device.

22. The golf training apparatus of claim 21, wherein said means for adjusting the swing plane of the swinging device comprises an angle gauge having a plurality of lock apertures, a lock pin for selectively engaging one of said lock apertures, and a plurality of angular pivot joints attaching said stand to said swinging device.

23. The golf training apparatus of claim 18, wherein said guide loop is an inner loop, said base loop is an outer loop, and said inner loop is supported within said outer loop.

24. The golf training apparatus of claim 18, wherein said means for moving said guide loop on said base loop comprises a simulated club;

said simulated club comprises a shaft and a universal joint, wherein said universal joint pivotally attaches said shaft to said guide loop;

said shaft comprises a plurality of telescoping rods which allow the length of said shaft to vary when said telescoping rods slide relative to each other during movement of said simulated club.

25. The golf training apparatus of claim 18, wherein each of said supporting brackets comprises a stabilizing arm; and wherein each of said stabilizing arms overlays a portion of said guide rail on said guide loop and maintains said guide rail proximate to said first and second rollers.

26. The golf training apparatus of claim 18 wherein said guide loop comprises opposing inside and outside surfaces and a guide rail;

wherein said guide rail extends outwardly from said outside surface, and said first and second rollers engage said guide rail.

27. A golf training apparatus for improving swing form and muscle tone of a golfer and maintaining a correct swing plane of the golfer, the golf training apparatus comprising:

a swinging device; and a stand for supporting the swinging device;

said swinging device comprises a base loop, a guide loop, means for moveably supporting the guide loop on the base loop, and means for moving the guide loop on the base loop;

wherein said means for moveably supporting the guide loop on the base loop comprises a plurality of roller supports mounted on said base loop, whereby said roller supports rotatably support said guide loop;

wherein each of said plurality of roller supports comprises a first roller, a second roller and a supporting bracket; and wherein said first and second rollers are mounted on the supporting bracket of said roller support, said supporting bracket is mounted on said base loop, and said first roller extends generally perpendicularly to said second roller on said roller support;

said guide loop comprises opposing inside and outside surfaces and a guide rail;

wherein said guide rail extends outwardly from said outside surface, said first and second rollers engage said guide rail, and said means for moving the guide loop on the base loop is mounted on the inside surface of said guide loop.

28. The golf training apparatus of claim 27, wherein each of said supporting brackets comprises a stabilizing arm; and wherein each of said stabilizing arms overlays a portion of said guide rail on said guide loop and maintains said guide rail proximate to said first and second rollers.

29. A golf training apparatus for improving swing form and muscle tone of a golfer while maintaining a correct swing plane of the golfer, the golf training apparatus comprising:

a swinging device having a swing plane;

a stand for supporting the swinging device; and an angle adjuster;

wherein said angle adjuster supports the swinging device at various selected angles on the stand;

said stand comprises a base, a plurality of upright supports and a height adjustment device for adjusting the height of the swinging device;

said swinging device comprises an outer base loop, an inner guide loop, and means for moveably supporting the inner guide loop on the outer base loop;

said swinging device further comprises a tensioning device and means for moving the inner guide loop on the outer base loop;

said angle adjuster comprises a plurality of angular pivot joints and an angle gauge, wherein each of said angular pivot joints pivotally connects a respective upright support to the outer base loop of the swinging device;

said angle gauge having a plurality of lock apertures and a lock pin for selectively engaging one of said lock apertures;

said outer base loop having an outer base loop diameter;

said inner guide loop is a swing track comprising an inside surface, an outside surface, a guide rail and tool guide, wherein said inner guide loop is substantially circular and is generally surrounded by said outer base loop;

said guide rail is disposed on the outside surface of said inner guide loop adjacent to a rear edge thereof and extends around a perimeter of the inner guide loop;

said tensioning device includes a pivot arm, a tension shoe, an angle bracket and a tension adjuster;

said tension adjuster is elongated and comprises a handle, an engaging portion and a threaded portion;

wherein said handle is disposed on a first end of the tension adjuster, said engaging portion is disposed on a second end of the tension adjuster, and said threaded portion is disposed on a midsection positioned between said first and second ends on the tension adjuster;

said means for moveably supporting the inner guide loop on the outer base loop is a loop holder which comprises a plurality of roller supports, wherein said plurality of roller supports are disposed around a perimeter of the outer base loop;

each of said roller supports comprises a first roller, a second roller, and a supporting bracket;

each of said supporting brackets comprises a generally L-shaped stabilizing arm;

wherein each of said stabilizing arms overlays a portion of the guide rail of the inner guide loop and maintains the guide rail proximate to each of the second rollers;

wherein said tension shoe of the tensioning device adjustably and selectively engages the first roller on the respective roller support adjacent to the tensioning device;

said the inner guide loop on the outer base loop comprises a simulated club;

said simulated club comprises a shaft, a grip and a universal joint, wherein said shaft is elongated, comprises inner and outer telescoping rods, and said inner and outer telescoping rods are relatively moveable so that the shaft is variable in length;

wherein said grip is disposed on one end of the shaft, and said universal joint is disposed on an opposite end of the shaft;

said universal joint comprises a ball and socket, wherein the ball is pivotally mounted in the socket and said ball can be selectively inserted into and removed from the socket;

wherein said simulated club is removably attached to the inside surface of said inner guide loop by said universal joint;

said base includes a frame and a platform for supporting a user;

said upright supports include a pair of adjusting telescoping members;

said height adjustment device includes at least one lock, wherein said at least one lock is positioned on at least one upright support;

said lock includes a threaded sleeve and a set screw, wherein said set screw is threadedly engaged within said threaded sleeve to selectively engage and lock the telescoping members of the upright support in various selected adjustable positions to adjust the height of the swinging device.

30. A swing training apparatus comprising:

a swinging device; and a stand for supporting the swinging device; and an adjustable tensioning device for maintaining resistance to movement of the guide loop relative to the base loop;

said swinging device comprising a guide loop, a base loop, a loop holder and a tool;

wherein said guide loop is moveably supported on the base loop by the loop holder; and wherein said tool is attached to said guide loop, whereby swinging said tool actuates movement of the guide loop on the base loop;

wherein said loop holder comprises a plurality of roller supports mounted on said base loop and supporting said guide loop;

wherein said adjustable tensioning device is disposed on said base loop adjacent to one of said roller supports and further comprises a tension shoe and a tension adjuster; and wherein said tension shoe can adjustably engage one of said rollers to apply selective resistance to movement of the guide loop relative to the base loop.

31. The swing training apparatus of claim 30, wherein said tool comprises a universal joint and said tool is attached to said guide loop by said universal joint.

32. The swing training apparatus of claim 30, wherein said tool comprises a shaft having a variable length.

33. The swing training apparatus of claim 32, wherein said shaft further comprises a plurality of telescoping rods;

whereby the length of said shaft varies as said telescoping rods slide relative to each other during said swinging of said tool.

34. The swing training apparatus of claim 30, wherein said tool comprises a simulated golf club.

35. The swing training apparatus of claim 30, wherein said tool comprises a simulated bat.

36. The swing training apparatus of claim 30, wherein said tool comprises a simulated racket.

37. The swing training apparatus of claim 30, wherein said tool comprises a simulated implement which is swung during participation in a related sport.

38. A swing training apparatus comprising:

a swinging device; and a stand for supporting the swinging device; and an adjustable tensioning device for maintaining resistance to movement of the guide loop relative to the base loop;

said swinging device comprising a guide loop, a base loop, a loop holder and a tool;

wherein said guide loop is moveably supported on the base loop by the loop holder; and wherein said tool is attached to said guide loop, whereby swinging said tool actuates movement of the guide loop on the base loop.

* * * * *

UNITED STATES PATENT AND TRADEMARK OFFICE

CERTIFICATE OF CORRECTION

PATENT NO. : 9,283,463 B2
APPLICATION NO. : 13/633595
DATED : March 15, 2016
INVENTOR(S) : Zimmerman, II et al.

It is certified that error appears in the above-identified patent and that said Letters Patent is hereby corrected as shown below:

In the Specification:

In the Detailed Description, column 5, line 9 of the Patent, change the word "cuter" to -- outer --.

In the Detailed Description, column 6, line 10 of the Patent, change the word "cuter" to -- outer --.

In the Detailed Description, column 6, line 24 of the Patent, change the word "cuter" to -- outer --.

In the Detailed Description, column 6, line 29 of the Patent, change the word "cuter" to -- outer --.

In the Detailed Description, column 6, line 64 of the Patent, change the word "cuter" to -- outer --.

Signed and Sealed this
Fourteenth Day of June, 2016

Michelle K. Lee

Michelle K. Lee
*Director of the United States Patent and Trademark Office*